US005168025A

United States Patent [19]

Ono et al.

[11] Patent Number: 5,168,025

[45] Date of Patent: Dec. 1, 1992

[54] ELECTROPHOTOGRAPHIC PHOTORECEPTOR

[75] Inventors: Hitoshi Ono, Yokohama; Atsuo Saita, Machida, both of Japan

[73] Assignee: Mitsubishi Kasei Corporation, Tokyo, Japan

[21] Appl. No.: 757,525

[22] Filed: Sep. 11, 1991

[30] Foreign Application Priority Data

Sep. 12, 1990 [JP] Japan ..... 2-242042
Jul. 18, 1991 [JP] Japan ..... 3-178488

[51] Int. Cl.[5] ..... G03G 5/047

[52] U.S. Cl. ..... 430/59; 430/70; 430/71; 430/72; 430/73; 430/74; 430/76; 430/77; 430/78; 430/83

[58] Field of Search ..... 430/59, 73, 74, 76, 430/70, 71, 72, 77, 78, 83

[56] References Cited

U.S. PATENT DOCUMENTS

| | | | |
|---|---|---|---|
| 3,387,973 | 6/1968 | Fox et al. | 430/73 |
| 3,526,501 | 9/1970 | Fox | 430/73 |
| 3,624,226 | 11/1971 | Hoover et al. | 430/73 |
| 3,994,724 | 11/1976 | Mattor . | |
| 4,665,000 | 5/1987 | Tokoli et al. . | |
| 4,882,253 | 11/1989 | Kato et al. | 430/59 |

FOREIGN PATENT DOCUMENTS

| | | | |
|---|---|---|---|
| 2005462 | 9/1970 | Fed. Rep. of Germany . | |
| 57-210343 | 12/1982 | Japan | 430/59 |
| 1294136 | 10/1972 | United Kingdom | 430/59 |

OTHER PUBLICATIONS

Patent Abstracts of Japan, vol. 7, No. 146 (P-206) (1291), Jun. 25, 1983, and JP-A-58 058 551, Apr. 7, 1983, Y. Takei, et al., "Electrophotographic Receptor".

*Primary Examiner*—Marion E. McCamish
*Assistant Examiner*—C. D. RoDee
*Attorney, Agent, or Firm*—Oblon, Spivak, McClelland, Maier & Neustadt

[57] ABSTRACT

An electrophotographic photoreceptor comprising an electrically conductive support and a photosensitive layer formed thereon, wherein said photosensitive layer contains an arylamine compound of the formula (I):

(I)

wherein each of $Ar^1$ and $Ar^2$ which may be the same or different, is an arylene group which may have substituents, each of $R^1$, $R^2$, $R^3$ and $R^4$ which may be the same or different, is an alkyl group which may have substituents, an aryl group which may have substituents, or a heterocyclic group which may have substituents, provided that $R^1$ may, together with $R^2$ or $Ar^1$, form a ring containing the adjacent nitrogen atom, and $R^3$ may, together with $R^4$ or $Ar^2$, form a ring containing the adjacent nitrogen atom, each of $R^5$, $R^6$, $R^7$ and $R^8$ which may be the same or different, is a hydrogen atom, an alkyl group which may have substituents, an aryl group which may have substituents, or a heterocyclic group which may have substituents, and each of m and n which may be the same or different, is an integer of from 1 to 6.

10 Claims, 1 Drawing Sheet

ELECTROPHOTOGRAPHIC PHOTORECEPTOR

Figure 1:
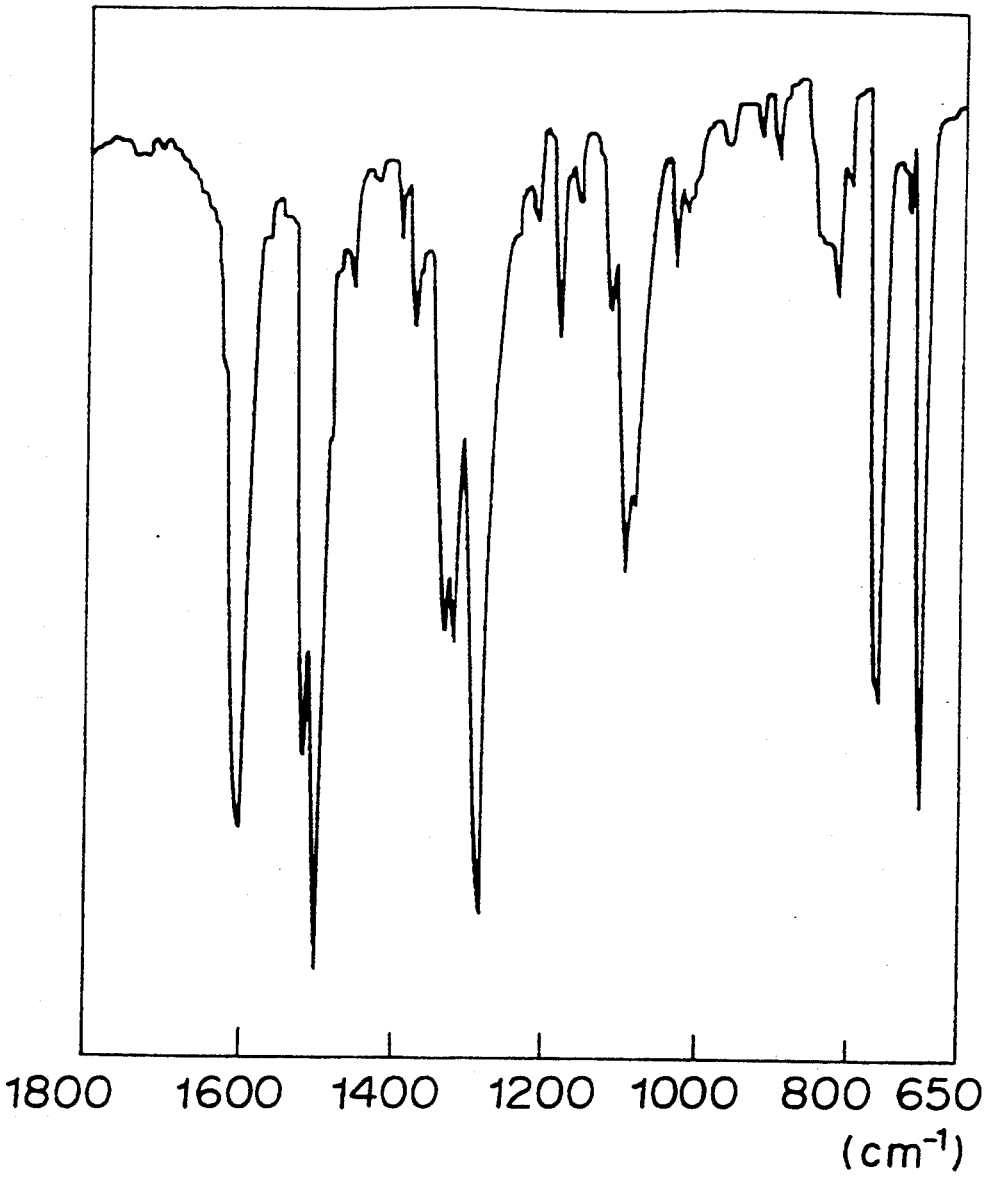

This invention relates to an electrophotographic photoreceptor. More particularly, it relates to a highly sensitive electrophotographic photoreceptor having a photosensitive layer comprising an organic photoconductive material.

Heretofore, inorganic photoconductive materials such as selenium, cadmium sulfide and zinc oxide have been widely used in the photosensitive layers of the electrophotographic photoreceptors. However, selenium and cadmium sulfide are required to be recovered as toxic substances. Further, selenium is crystallized by heat and thus is inferior in the heat resistance. Cadmium sulfide and zinc oxide are inferior in the moisture resistance. Zinc oxide has a drawback that it is poor in the printing resistance. Under these circumstances, research efforts are still being made to develop novel photosensitive materials. Recently, studies on use of organic photoconductive materials for the photosensitive layers of the electrophotographic photoreceptors have been advanced, and some of them have materialized into practical use. The organic photoconductive materials have many advantages over the inorganic materials. For example, they are light in weight and easy to fabricate into films, and they can be easily manufactured into photoreceptors or into transparent photoreceptors depending upon the certain kinds of the material.

Recently, the current research activities are directed to so-called function-separated photoreceptors whereby functions of generating and transporting electric charge carriers are performed by separate compounds, since they are effective for high sensitivity, and organic photoreceptors of this type have been practically employed.

As a carrier transporting material, a polymer-type photoconductive compound such as polyvinyl carbazole may be employed. Otherwise, a low molecular weight photoconductive compound may be used as dispersed or dissolved in a binder polymer.

Particularly in the case of an organic low molecular weight photoconductive compound, it is possible to select as a binder a polymer excellent in the film-forming property, flexibility and adhesive property, whereby a photoreceptor excellent in the mechanical properties can readily be obtained (e.g. Japanese Unexamined Patent Publications No. 17442/1976 and No. 228450/1986). However, it has been difficult to find a suitable compound for the preparation of a highly sensitive photoreceptor.

The present inventors have conducted extensive researches for organic low molecular weight photoconductive compounds capable of presenting electrophotographic photoreceptors having high sensitivity and high durability and as a result, have found that certain specific arylamine compounds are suitable for this purpose. The present invention has been accomplished on the basis of this discovery.

Thus, the present invention provides an electrophotographic photoreceptor comprising an electrically conductive support and a photosensitive layer formed thereon, wherein said photosensitive layer contains an arylamine compound of the formula (I):

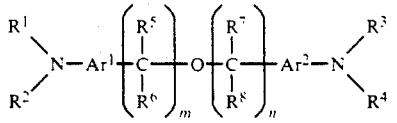

(I)

wherein each of $Ar^1$ and $Ar^2$ which may be the same or different, is an arylene group which may have substituents, each of $R^1$, $R^2$, $R^3$ and $R^4$ which may be the same or different, is an alkyl group which may have substituents, an aryl group which may have substituents, or a heterocyclic group which may have substituents, provided that $R^1$ may, together with $R^2$ or $Ar^1$, form a ring containing the adjacent nitrogen atom, and R3 may, together with $R^4$ or $Ar^2$, form a ring containing the adjacent nitrogen atom, each of $R^5$, $R^6$, $R^7$ and $R^8$ which may be the same or different, is a hydrogen atom, an alkyl group which may have substituents, an aryl group which may have substituents, or a heterocyclic group which may have substituents, and each of m and n which may be the same or different, is an integer of from 1 to 6.

In the accompanying drawing, FIG. 1 is an infrared absorption spectrum of the arylamine compound obtained in Preparation Example 1.

Now, the present invention will be described in detail with reference to the preferred embodiments.

The electrophotographic photoreceptor of the present invention contains the arylamine compound of the above formula (I) in the photosensitive layer.

In the formula (I), each of $Ar^1$ and $Ar^2$ which may be the same or different, is an arylene group such as a phenylene group, a naphthylene group or an anthracenyl group. A phenylene group is particularly preferred. These arylene groups may have substituents. The substituents include, for example, a hydroxyl group; a halogen atom such as a chlorine atom, a bromine atom or an iodine atom; an alkyl group such as a methyl group, an ethyl group, a propyl group, a butyl group or a hexyl group; an alkoxy group such as a methoxy group, an ethoxyl group or a butoxy group; an allyl group; an aralkyl group such as a benzyl group, a naphthylmethyl group or a phenethyl group; an aryloxy group such as a phenoxy group or tolyloxy group; an aryloxy group such as a benzyloxy group or a phenethyloxy group; an aryl group such as a phenyl group or a naphthyl group; an aryl vinyl group such as a styryl group or a naphthyl vinyl group; a dialkylamino group such as a dimethylamino group or a diethylamino group; a diarylamino group such as a diphenylamino group or a dinaphthylamino group; a diaralkylamino group such as a dibenzylamino group or a diphenethylamino group; a dihetorocyclic amino group such as a dipyridylamino group or a dithienylamino group; a diallylamino group; and a di-substituted amino group having a combination of substituents of the above amino groups.

Further, the position of

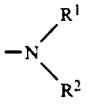

substituted on $Ar^1$ and the position of

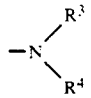

substituted on $Ar^2$ are preferably para-positions of the respective benzene rings directly bonded to

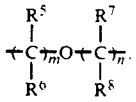

Each of $R^1$, $R^2$, $R^3$ and $R^4$ which may be the same or different, is an alkyl group such as a methyl group, an ethyl group, a butyl group or a hexyl group; an aryl group such as a phenyl group, a naphthyl group or an anthracenyl group; or a heterocyclic group such as a pyrrolyl group, a thiophenyl group or a furyl group. An aryl group is preferred, and particularly preferred is a phenyl group.

Such an alkyl group may have substituents. The substituents include, for example, a halogen atom such as a chlorine atom, a bromine atom or an iodine atom; an alkyl group such as a methyl group, an ethyl group, a propyl group, a butyl group or a hexyl group; an alkoxy group such as a methoxy group, an ethoxy group or a butoxy group; an allyl group; an aralkyl group such as a benzyl group, a naphthylmethyl group or a phenethyl group; an aryloxy group such as a phenoxy group or a tolyloxy group; an arylalkoxy group such as a benzyloxy group or a phenethyloxy group; an aryl group such as a phenyl group or a naphthyl group; an aryl vinyl group such as a styryl group or a naphthyl vinyl group; a dialkylamino group such as a dimethylamino group or a diethylamino group; a diarylamino group such as a diphenylamino group or a dinaphthylamino group; a diaralkylamino group such as a dibenzylamino group or a diphenethylamino group; a di-hetorocyclic amino group such as a dipyridylamino group or a dithienylamino group; a diallylamino group; and a di-substituted amino group having a combination of substituents of the above amino groups.

The above aryl group and the heterocyclic group may have substituents. The substituents include, for example, a hydroxyl group; a halogen atom such as a chlorine atom, a bromine atom or an iodine atom; an alkyl group such as a methyl group, an ethyl group, a propyl group, a butyl group or a hexyl group; an alkoxy group such as a methoxy group, an ethoxy group or a butoxy group; an allyl group; an aralkyl group such as a benzyl group, a naphthylmethyl group or a phenethyl group; an aryloxy group such as a phenoxy group or a tolyloxy group; an arylalkoxy group such as a benzyloxy group or a phenethyloxy group; an aryl group such as a phenyl group or a naphthyl group; an aryl vinyl group such as a styryl group or a naphthyl vinyl group; a dialkylamino group such as a dimethylamino group or a diethylamino group; a diarylamino group such as a diphenylamino group or a dinaphthylamino group; a diaralkylamino group such as a dibenzylamino group or a diphenethylamino group; a dihetorocyclic amino group such as a dipyridylamino group or a dithienylamino group; a diallylamino group; and a di-substituted amino group having a combination of substituents of the above amino groups.

Each of $R^5$, $R^6$, $R^7$ and $R^8$ which may be the same or different is a hydrogen atom; an alkyl group such as a methyl group, an ethyl group, a propyl group, a butyl group or a hexyl group; an aryl group such as a phenyl group, a naphthyl group or an anthracenyl group; or a heterocyclic group such as a pyrollyl group, a thiophenyl group or a furyl group. Particularly preferred is a hydrogen atom or an alkyl group. The alkyl group, the aryl group and the heterocyclic group may have substituents. The substituents include, for example, a hydroxyl group; a halogen atom such as a chlorine atom, a bromine atom or an iodine atom; an alkyl group such as a methyl group, an ethyl group, a propyl group, a butyl group or a hexyl group; an alkoxy group such as a methoxy group, an ethoxy group or a butoxy group; an allyl group; an aralkyl group such as a benzyl group, a naphthylmethyl group or a phenethyl group; an aryloxy group such as a phenoxy group or a tolyloxy group; an arylalkoxy group such as a benzyloxy group or a phenethyloxy group; an aryl group such as a phenyl group or a naphthyl group; an aryl vinyl group such as a styryl group or a naphthyl vinyl group; a dialkylamino group such as a dimethylamino group or a diethylamino group; a diarylamino group such as a diphenylamino group or a dinaphthylamino group; a diaralkylamino group such as a dibenzylamino group or a diphenethylamino group; a di-hetorocyclic amino group such as a dipyridylamino group or a dithienylamino group; a diallylamino group; and a di substituted amino group having a combination of substituents of the above amino groups.

However, with respect to $Ar^1$ and $Ar^2$, and $R^1$, $R^2$, $R^3$ and $R^4$, the present invention covers a case wherein they constitute a trivalent or bivalent substituent forming a ring derived from the above-mentioned respective substuents. Namely, $R^1$ may, together with $R^2$ or $Ar^1$, form a ring containing the adjacent nitrogen atom. Likewise, $R^3$ may, together with $R^4$ or $Ar^2$, form a ring containing the adjacent nitrogen atom. As such a case, a pyrrolidyl group, a piperidyl group, a morpholino group or a carbazolyl group may, for example, be mentioned.

Each of m and n which may be the same or different, is an integer of from 1 to 6. Particularly preferred is an integer of from 1 to 3.

The arylamine compound of the formula (I) can be produced by a known method.

As a preferred method, a method may be mentioned wherein a starting material alcohol is subjected to a dimerization condensation reaction to obtain the desired compound, or a method may be mentioned wherein an alcohol and a halogen compound are reacted to obtain the desired compound.

The former method will be described in detail. In a case where m=n=1, an alcohol of the formula (II):

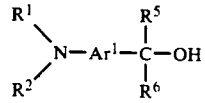

(II)

wherein $Ar^1$, $R^1$, $R^2$, $R^5$ and $R^6$ are as defined above with respect to the formula (I), is heated at a temperature of from 100 to 200° C., preferably from 150 to 190° C., in the presence of e.g. dimethylsulfoxide, to obtain a compound of the formula (I).

According to the above method, a compound wherein $Ar^1=Ar^2$, $R^1=R^4$, $R^2=R^4$, $R^5=R^7$ and $R^6=R^8$, is obtainable. However, by using two or more compounds as the alcohol of the formula (II), it is possible to obtain a compound of the formula (I) wherein $Ar^1$ and $Ar^2$, $R^1$ and $R^3$, $R^2$ and $R^4$, $R^5$ and $R^7$, or $R^6$ and $R^8$, are different from each other.

The latter method will be described in detail. When m is an integer of from 1 to 6, and n is an integer of from 2 to 6, a compound of the formula (I) can be obtained also by a reaction of a compound of the formula (III) with a halogen compound of the formula (IV):

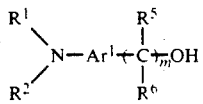

(III)

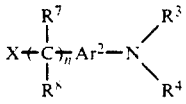

(IV)

wherein $Ar^1$, $Ar^2$, $R^1$, $R^2$, $R^3$, $R^4$, $R^5$, $R^6$, $R^7$ and $R^8$ are as defined above with respect to the formula (I), and X is a halogen atom such as a chlorine atom or a bromine atom.

In the above two reactions, after completion of the process, a known purification method such as recrystallization, sublimation or column chromatography may be applied, as the requires, to obtain a highly pure product.

The electrophotographic photoreceptor of the present invention has a photosensitive layer containing one or more of the arylamine compounds of the formula (I).

The arylamine compound of the formula (I) exhibits excellent properties as an organic photoconductive material. Especially when used as a carrier transport material, it gives a photoreceptor having high sensitivity and excellent durability.

Various types are known for the photosensitive layer for an electrophotographic photoreceptor. The photosensitive layer of the electrophotographic photoreceptor of the present invention may be any one of such types. For example, the following types may be mentioned:

(i) a photosensitive layer having the arylamine compound, a carrier generation material (photoconductive particles capable of generating an electric charge carrier at an extremely high efficiency upon absorption of light, a pigment useful as a sensitizing agent) and a compound capable of forming a charge transfer complex together with the arylamine compound added in a binder.

(ii) a photosensitive layer having the carrier generation material and the arylamine compound added in a binder.

(iii) a photosensitive layer having laminated a carrier transport layer composed of the arylamine compound and a binder and a carrier generation layer composed of photoconductive particles (carrier generation material) capable of generating an electric charge carrier at a extremely high efficiency upon absorption of light, or composed of such photoconductive particles and a binder.

In such a photosensitive layer, a known hydrazone compound or stilbene compound having excellent properties as an organic photoconductive material, may be incorporated together with the arylamine compound of the formula (I).

In the present invention, when the arylamine compound of the formula (I) is used in a carrier transport layer of a photosensitive layer which comprises two layers of the carrier transport layer and a carrier generation layer, it is possible obtain a photoreceptor having particularly high sensitivity and low residual potential and which has excellent durability such that even when used repeatedly, the change in the surface potential, the deterioration of the sensitivity or the accumulation of the residual potential is small.

The electrophotographic photoreceptor of the present invention can be prepared in accordance with a usual method by dissolving the arylamine compound of the formula (I) together with the binder in a suitable solvent, adding photoconductive particles capable of generating an electric charge carrier at an extremely high efficiency upon absorption of light, a sensitizing dye, an electron attracting compound, a plasticizer, a pigment or other additives, as the case requires, to obtain a coating solution, and then applying such a coating solution on an electrically conductive support, followed by drying to form a photosensitive layer having a thickness of from a few μm to a few tens μm. The photosensitive layer comprising two layers of the carrier generation layer and the carrier transport layer can be prepared either by applying the above mentioned coating solution on the carrier generation layer, or forming a carrier generation layer on the carrier transport layer obtained by coating the above mentioned coating solution.

The solvent useful for the preparation of the coating solution is a solvent capable of dissolving the arylamine, for example, an ether such as tetrahydrofuran or 1,4-dioxane; a ketone such as methyl ethyl ketone or cyclohexanone; an aromatic hydrocarbon such as toluene or xylene; an aprotic polar solvent such as N,N-dimethylformamide, acetonitrile, N-methyl pyrrolidone or dimethyl sulfoxide; an ester such as ethyl acetate, methyl formate or methyl cellosolve acetate; or a chlorinated hydrocarbon such as dichloroethane or chloroform. It is of course necessary to select among them the one capable of dissolving the binder. The binder may be a polymer or copolymer of a vinyl compound such as styrene, vinyl acetate, vinyl chloride, an acrylate, a methacrylate or butadiene, or various polymers compatible with a styrene compound, such as polyvinyl acetal, polycarbonate, polyester, polysulfone, polyphenyleneoxide, polyurethane, cellulose ester, cellulose ether, a phenoxy resin, a silicone resin and an epoxy resin. The binder is used usually in an amount within a range of from 0.5 to 30 times by weight, preferably from 0.7 to 10 times by weight, relative to the arylamine compound.

The photoconductive particles, dyes, pigments or electron attracting compounds to be added to the photosensitive layer may be those well known in the art. The photoconductive particles capable of generating charge carriers at an extremely high efficiency upon absorption of light, include inorganic photoconductive particles such as selenium-tellurium alloy, selenium-arsenic alloy and a cadmium sulfide and amorphous silicon; and organic photoconductive particles such as metal-containing phthalocyanine, perinone dyes, thioindigo dyes, quinacridone, perylene dyes, anthraquinone dyes, azo dyes, bisazo dyes, trisazo dyes, tetrakisazo dyes and cyanine dyes. The dyes include, for example, triphenylmethane dyes such as Methyl Violet, Brilliant Green and Crystal Violet; thiazine dyes such as Methylene Blue; quinone dyes such as Quinizalin and cyanine dyes as well as pyrilium salts, thiapyrilium salts and benzopyrilium salts. The electron attracting compound capable of forming a carrier transport complex together with the arylamine compound, includes quinones such as chloranil, 2,3-dichloro-1,4-naphthoquinone, 1-nitroanthraquinone, 1-chloro-5-nitroanthraquinone, 2-chloroanthraquinone and phenanthrenequinone; aldehydes such as 4-nitrobenzaldehyde; ketones such as 9-benzoylanthracene, indanedione, 3,5-dinitrobenzophenone, 2,4,7-trinitrofluorenone, 2,4,5,7-tetranitrofluorenone and 3,3',5,5'-tetranitrobenzophenone; acid anhydrides such as phthalic anhydride and 4-chloronaphthalic anhydride; cyano compounds such as tetracyanoethylene, terephthalal malononitrile, 9-anthrylmethylidene malononitrile, 4-nitrobenzal malononitrile and 4-(p-nitrobenzoyloxy) malononitrile; and phthalides such as 3-benzalphthalide, 3-(α-cyano-p-nitrobenzal)phthalide and 3-(α-cyano-p-nitrobenzal)-4,5,6,7-tetrachlorophthalide.

Further, the photosensitive layer of the electorphotographic photoreceptor according to this invention may contain a well-known plasticizer for the improvement of the film-forming properties, flexibility and mechanical strength. The plasticizer to be added to the above coating solution for this purpose may be a phthalic ester, a phosphoric ester, an epoxy compound, a chlorinated paraffin, a chlorinated fatty acid ester or an aromatic compound such as methylnaphthalene. In a case where the arylamine compound is used as a carrier transport material in the carrier transport layer, the coating solution may be of the above described composition, but photoconductive particles, dyes, pigments, electron attracting compounds and the like may be eliminated or added in a small amount. The carrier generation layer in this case includes a layer prepared by forming the above mentioned photoconductive particles into a film by means of e.g. vapor position, and a thin layer prepared by applying a coating solution which is obtained by dissolving or dispersing the photoconductive particles and optionally a binder polymer as well as an organic photoconductive material, a dye and an electron attracting compound in a solvent, and drying it.

The photoreceptor thus formed may further have an adhesive layer, an intermediate layer, a transparent insulation layer or the like, as the case requires. As the electrically conductive support on which the photosensitive layer is formed, any material which is commonly used for electrophotographic photoreceptors, can be employed. Specifically, a drum or sheet of a metal such as aluminum, stainless steel or copper, or a laminate of foils of such metals, or a vapor-deposition product of such metals, may be mentioned. Further, a plastic film, a plastic drum, paper or a paper tube electrified by coating a conductive material such as metal powder, carbon black, copper iodide or a polymer electrolyte together with an appropriate binder, may be mentioned. Further, an electrically conductive plastic sheet or drum containing a conductive substance such as metal powder, carbon black or carbon fiber, may be mentioned.

The electrophotographic photoreceptor of the present invention has a very high sensitivity and a small residual potential which is likely to cause fogging, and it has a feature of excellent durability since the accumulation of the residual potential due to repeated use and fluctuations in the surface potential and in the sensitivity are minimum as the light-fatigue is minimum.

Now, the present invention will be described in further detail with reference to Examples. However, it should be understood that the present invention is by no means restricted by such specific Examples. In the Examples, "parts" means "parts by weight".

PREPARATION EXAMPLE 1

5.0 g of 4-hydroxymethylphenyl-diphenylamine of the formula:

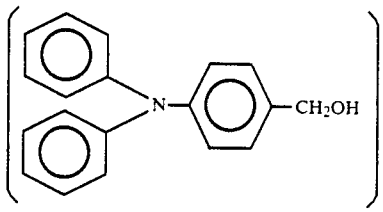

and 0.2 g of dimethylsulfoxide were stirred at 180° C. for two hours and thirty minutes, then left to cool and subjected to purification treatment to obtain 3.8 g of white crystals (melting point: 111-113° C.).

This compound was found to be an arylamine compound of the following formula from the following values of elemental analysis, the mass spectrometric analysis and the infrared absorption spectrum analysis (FIG. 1):

| | Elemental analysis: As $C_{38}H_{32}N_2O$ | | |
|---|---|---|---|
| | C % | H % | N % |
| Calculated | 85.68 | 6.06 | 5.26 |
| Found | 85.45 | 6.30 | 5.16 |

Results of mass spectrometric analysis: As $C_{38}H_{32}N_2O$ NW=532, $M^+$=532.

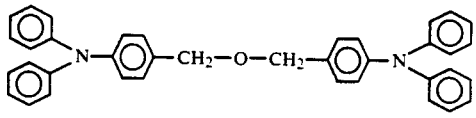

EXAMPLE 1

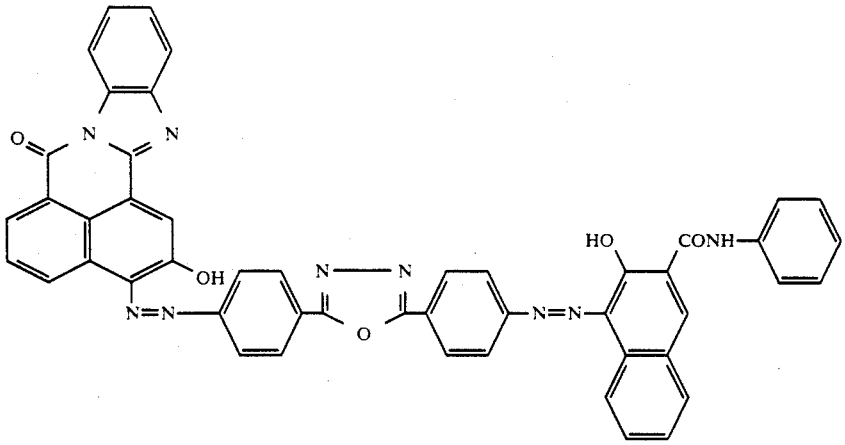

1.4 parts of a bisazo dye having the above formula, 0.7 part of a polyvinyl butyral resin (#6000/C., manufactured by Denki Kagaku Kogyo K.K.) and 0.7 part of a phenoxy resin (PKHH, registered trademark, manufactured by Union Carbide Company) were dispersed and pulverized in 44 parts of methyl ethyl ketone and 15 parts of 4-methoxy-4-methylpentanone-2 by a sand-grinder.

This dispersion was coated by a wire bar on an aluminum layer vapor-deposited on a polyester film having a thickness of 75 μm so that the weight after drying would be 0.7 g/m$^2$, followed by drying to form a carrier generation layer.

A coating solution prepared by dissolving 80 parts of the arylamine compound prepared in Preparation Example 1 and 100 parts of a polycarbonate (Upirone E2000, registered trademark, manufactured by Mitsubishi Gas Kagaku K.K.) in 900 parts of dioxane, was coated thereon and dried to form a carrier transport layer having a thickness of 20 μm.

With respect to the electrophotographic photoreceptor having a photosensitive layer comprising two layers thus obtained, the sensitivity i.e. the half-decay exposure intensity (E ½) was measured and found to be 1.1 lux·sec.

Here, the half-decay exposure intensity was determined by firstly charging the photoreceptor in a dark place with corona discharge at −5.2 KV, then subjecting it to exposure to incandescent light, and measuring the exposure intensity required until the surface potential decayed to one-half of the initial surface potential.

EXAMPLE 2

A photoreceptor was produced in the same manner as Example 1 except that a bisazo dye of the following formula was used instead of the bisazo dye used in Example 1, and the sensitivity was measured in the same manner as in Example 1 and found to be 2.1 lux·sec.

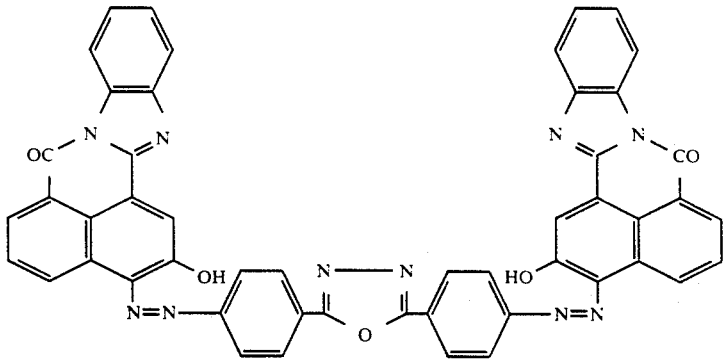

EXAMPLES 3 to 29

Electrophotographic photoreceptors were produced in the same manner as in Example 1 except that the following arylamine compounds were used instead of the arylamine compound used in Example 1 and the bisazo dye used in Example 1 was used for the carrier generation layer, and their sensitivities are shown in the following Table 1.

Now, the chemical structures of the compounds used in the following respective Examples will be shown. Unless otherwise specified, each of $Ar^1$ and $Ar^2$ is a p-phenylene group, and each of $R^1$, $R^2$, $R^3$ and $R^4$ is a phenyl group, and each of $R^5$, $R^6$, $R^7$ and $R^8$ is a hydrogen atom. Further, each of m and n is 1.

However, $Ar^1$ and/or $Ar^2$ is a p-phenylene group having substituents. The positions of the substituents will be indicated by numerical values whereby the carbon atom bonded to the nitrogen atom is designated as 1, the adjacent carbon atom is designated as 2 and the rest of carbon atoms are sequentially designated as 3, 4, 5 and 6, respectively.

In a case where $Ar^1$ and/or $Ar^2$ is a naphthylene group or an anthracenyl group, it is bonded to the nitrogen atom and to the carbon atom bonded to substituents $R^5$ and $R^6$ at the following positions:

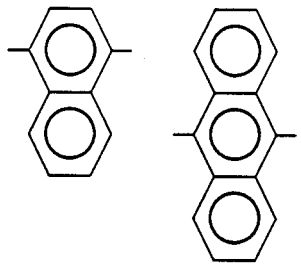

When $R^1$, $R^2$, $R^3$ and/or $R^4$ is a thienyl group or a furyl group, unless otherwise specified, it is bonded at the 2-position in the following respective formulas. Further, when the thienyl group or the furyl group has substituents, the positions of the substituents are indicated by the numerical values shown in the following respective formulas.

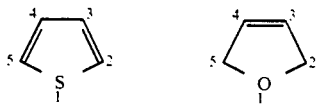

When $R^1$ forms a carbazol ring together with $Ar^1$ and the adjacent nitrogen atom, unless otherwise specified, the carbazol ring is bonded to the carbon atom to which $R^5$ and $R^6$ are bonded, at the 3-position shown in the following formula:

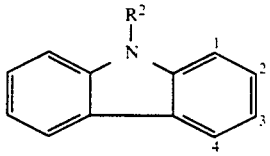

When $R^2$ forms a carbazol ring together with $Ar^2$ and the adjacent nitrogen atom, the same as above will apply.

| Example | Compoud | |
|---|---|---|
| 3 | $Ar^1$ and $Ar^2$: | anthracenyl group |
| | $R^1$, $R^2$, $R^3$ and $R^4$: | methyl group |
| 4 | $R^1$ and $R^3$: | methyl group |
| 5 | $R^1$ and $R^2$ form a ring containing the nitrogen atom: | piperidino group |
| 6 | $Ar^1$ and $Ar^2$: | p-phenylene group having a methyl group bonded at the 2-position |
| | $R^3$: | methyl group |
| 7 | $Ar^1$ and $Ar^2$: | naphthylene group |
| | $R^1$ and $R^2$: | p-tolyl group |
| 8 | $Ar^1$ and $Ar^2$: | p-phenylene group having a methyl group bonded at the 2-position |
| | $R^1$ and $R^3$: | thienyl group having a methyl group bonded at the 5-position |
| | $R^5$: | methyl group |
| 9 | $Ar^1$ and $Ar^2$: | p-phenylene group having a methoxy group bonded at the 2-position |

-continued

| Example | Compoud | |
|---|---|---|
| | $R^1$: | thienyl group having a methyl group bonded at the 5-position |
| | $R^3$: | p-tolyl group |
| | $R^5$ and $R^6$: | methyl group |
| 10 | $Ar^1$ and $Ar^2$: | naphthylene group |
| | $R^1$, $R^2$, $R^3$ and $R^4$: | furyl group |
| | $R^5$ and $R^7$: | methyl group |
| 11 | $Ar^1$ and $Ar^2$: | p-phenylene group having a chlorine atom bonded at the 2-position |
| | $R^1$, $R^2$, $R^3$ and $R^4$: | p-tolyl group |
| | $R^6$ and $R^7$: | thienyl group |
| 12 | $R^1$ and $R^2$ form a ring containing the nitrogen atom: | carbazolyl group |
| | $R^6$ and $R^7$: | p-tolyl group |
| 13 | $R^7$ and $R^8$: | methyl group |
| 14 | $R^1$ forms a ring together with $Ar^1$ and the nitrogen atom: | carbazolyl group |
| | $R^3$ forms a ring together with $Ar^2$ and the nitrogen atom: | carbazolyl group |
| | $R^2$ and $R^4$: | methyl group |
| | $R^5$, $R^6$, $R^7$ and $R^8$: | methyl group |
| 15 | $R^1$ and $R^3$: | p-tolyl group |
| 16 | $R^1$ and $R^3$: | phenyl group having a methoxy group bonded at the p-position |
| 17 | $Ar^2$: | p-phenylene having a chlorine atom bonded at the 2-position |
| | n: | 2 |
| 18 | $Ar^1$ and $Ar^2$: | p-phenylene group having a methyl group bonded at the 2-position |
| | $R^1$ and $R^3$: | fulyl group |
| | $R^5$: | methyl group |
| | n: | 4 |
| 19 | $Ar^1$ and $Ar^2$: | naphthylene group |
| | $R^1$ and $R^3$: | methyl group |
| | $R^5$ and $R^6$: | methyl group |
| | n: | 6 |
| 20 | $Ar^1$: | anthracenyl group |
| | $R^1$ and $R^3$: | p-tolyl group |
| | $R^6$: | methyl group |
| | m: | 2 |
| | n: | 2 |
| 21 | $Ar^1$: | p-phenylene group having a methoxy group bonded at the 2-position |
| | m: | 2 |
| | n: | 3 |
| 22 | $R^1$ and $R^2$ form a ring containing the nitrogen atom: | piperidino group |
| | m: | 2 |
| | n: | 4 |
| 23 | $R^1$ and $R^3$: | fulyl group |
| | $R^6$: | methyl group |
| | m: | 2 |
| | n: | 5 |
| 24 | $R^1$ forms a ring together with $Ar^1$ and the nitrogen atom: | carbazolyl group |
| | $R^3$: | p-tolyl group |
| | m: | 3 |
| | n: | 3 |
| 25 | $R^1$ and $R^2$: | thienyl group having a methyl group bonded at the 5-position |
| | $Ar^2$: | naphthylene group |
| | m: | 3 |
| | n: | 5 |

-continued

| Example | Compoud | |
|---|---|---|
| 26 | m: | 3 |
| | n: | 6 |
| 27 | $R^1$ and $R^3$: | p-tolyl group |
| | m: | 4 |
| | n: | 4 |
| 28 | $R^1$ and $R^3$: | methyl group |
| | $R^2$: | phenyl group having a methoxy group bonded at the p-position |
| | $Ar^2$: | p-phenylene group having a chlorine atom bonded at the 2-position |
| | $R^4$: | p-tolyl group |
| | m: | 5 |
| | n: | 6 |
| 29 | $R^1$ forms a ring together with $Ar^1$ and the nitrogen atom: | carbazolyl group |
| | $R^2$: | ethyl group |
| | $R^3$ and $R^4$ form a ring containing the nitrogen atom: | carbazolyl group |
| | m: | 6 |
| | n: | 6 |

We claim:

TABLE 1

| Example | Sensitivity (lux · sec) |
|---|---|
| 3 | 9.5 |
| 4 | 7.0 |
| 5 | 4.6 |
| 6 | 4.5 |
| 7 | 1.5 |
| 8 | 2.1 |
| 9 | 2.5 |
| 10 | 3.3 |
| 11 | 4.2 |
| 12 | 2.4 |
| 13 | 1.6 |
| 14 | 2.0 |
| 15 | 1.2 |
| 16 | 1.4 |
| 17 | 2.0 |
| 18 | 3.0 |
| 19 | 6.7 |
| 20 | 2.1 |
| 21 | 1.8 |
| 22 | 5.0 |
| 23 | 4.0 |
| 24 | 3.6 |
| 25 | 2.9 |
| 26 | 1.9 |
| 27 | 2.0 |
| 28 | 2.4 |
| 29 | 4.2 |

1. An electrophotographic photoreceptor comprising an electrically conductive support and a photosensitive layer formed thereon, wherein said photosensitive layer contains an arylamine compound of the formula (I):

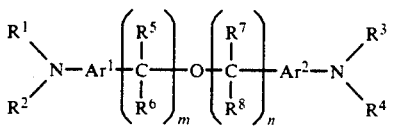

(I)

wherein each of $Ar^1$ and $Ar^2$ which may be the same or different, is an arylene group which may have substituents, each of $R^1$, $R^2$, $R^3$ and $R^4$ which may be the same or different, is an alkyl group which may have substituents, an aryl group which may have substituents, or a heterocyclic group which may have substituents, provided that $R^1$ may, together with $R^2$ or $Ar^1$, form a ring containing the adjacent nitrogen atom, and $R^3$ may, together with $R^4$ or $Ar^2$, form a ring containing the adjacent nitrogen atom, each of $R^5$, $R^6$, $R^7$ and $R^8$ which may be the same or different, is a hydrogen atom, an alkyl group which may have substituents, an aryl group which may have substituents, or a heterocyclic group which may have substituents and each of m and n which may be the same or different, is an integer of from 1 to 6.

2. The electrophotographic photoreceptor according to claim 1, wherein in the formula (I), each of $Ar^1$ and $Ar^2$ is a phenylene group which may have substituents.

3. The electrophotographic photoreceptor according to claim 2, wherein in the formula (I), the position of

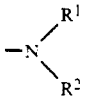

substituted on $Ar^1$ and the position of

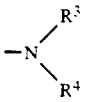

substituted on $Ar^2$ are para-positions of the respective benzene rings directly bonded to

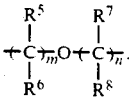

4. The electrophotographic photoreceptor according to claim 1, wherein in the formula (I), each of $R^1$, $R^2$, $R^3$ and $R^4$ is an aryl group which may have substituents.

5. The electrophotographic photoreceptor according to claim 1, wherein in the formula (I), each of $R^5$, $R^6$, $R^7$ and $R^8$ is a hydrogen atom or an alkyl group which may have substituents.

6. The electrophotographic photoreceptor according to claim 1, wherein in the formula (I), each of m and n is an integer of from 1 to 3.

7. The electrophotographic photoreceptor according to claim 1, wherein the photosensitive layer comprises a carrier generation layer and a carrier transport layer comprising the arylamine compound of the formula (I) and a binder.

8. The electrophotographic photoreceptor according to claim 1, wherein the photosensitive layer comprises the arylamine compound of the formula (I), a carrier generation material and a binder.

9. The electrophotographic photoreceptor according to claim 1, wherein the photosensitive layer comprises the arylamine compound of the formula (I), a carrier generation material, a compound capable of forming a charge transfer complex together with the arylamine compound of the formula (I) and a binder.

10. The electrophotographic photoreceptor according to claims 7, 8 or 9, wherein the binder is used in an amount of from 0.5 to 30 parts by weight per part by weight of the arylamine compound of the formula (I).

* * * * *